US006510871B2

(12) United States Patent
Baumann et al.

(10) Patent No.: US 6,510,871 B2
(45) Date of Patent: Jan. 28, 2003

(54) APPARATUS FOR THE MANUFACTURE OF LENO FABRICS

(75) Inventors: Heinz Baumann, Seuzach (CH); Georg Senn, Rüti (CH); Paul Lincke, Kollbrunn (CH)

(73) Assignee: Sulzer Textil AG, Rueti (CH)

( * ) Notice: Subject to any disclaimer, the term of this patent is extended or adjusted under 35 U.S.C. 154(b) by 0 days.

(21) Appl. No.: 10/042,885

(22) Filed: Jan. 7, 2002

(65) Prior Publication Data

US 2002/0121311 A1 Sep. 5, 2002

(30) Foreign Application Priority Data

Mar. 5, 2001 (EP) ..... 01810224

(51) Int. Cl.[7] ..... D03C 7/00
(52) U.S. Cl. ..... 139/50
(58) Field of Search ..... 139/50, 54, 48

(56) References Cited

U.S. PATENT DOCUMENTS

| | | | | |
|---|---|---|---|---|
| 1,776,102 A | | 9/1930 | Brooks | |
| 4,614,210 A | * | 9/1986 | Debaes | 139/54 |
| 5,123,454 A | | 6/1992 | Debaes | |
| 6,092,559 A | | 7/2000 | Dvorak et al. | |
| 6,382,262 B1 | * | 5/2002 | Herzig | 139/50 |

FOREIGN PATENT DOCUMENTS

| | | |
|---|---|---|
| DE | 466340 | 9/1928 |
| DE | 646462 | 5/1937 |
| FR | 2174675 | 10/1973 |
| JP | 61-83343 | 4/1986 |

* cited by examiner

*Primary Examiner*—Danny Worrell
(74) *Attorney, Agent, or Firm*—William Michael Hynes; Townsend and Townsend and Crew, LLP

(57) ABSTRACT

The apparatus for the manufacture of leno fabrics (1) in a weaving machine comprises a needle bar (3) for ground threads (13), at least one insertion element (4) for leno threads (4) and means for the insertion of weft threads (12). A pivotal arrangement (5, 6, 7) is connected directly to a main drive (51) of the weaving machine. The insertion element and the needle bar can be moved by means of this pivotal arrangement, so that the movement sequence which is required for the ground thread and leno thread results.

8 Claims, 4 Drawing Sheets

APPARATUS FOR THE MANUFACTURE OF LENO FABRICS

BACKGROUND OF THE INVENTION

The invention relates to an apparatus for the manufacture of leno fabrics and to a weaving machine comprising an apparatus of this kind.

An apparatus for the manufacture of leno fabrics is known for example from the patent specification DE 466 340 C, which appeared in 1928. In this apparatus a raking blade (designated in the following as a needle bar) is used for guiding the ground threads on the one hand and a shaft which is moved up and down is used for a movement of leno threads on the other hand. The vertical movement of the leno threads is a first component of movement. The leno threads are laterally displaced with the help of a suitably designed shaft frame and an insertion element; i.e. a displacement movement is carried out, with the binding which is typical for leno fabrics arising through this second component of movement. The idea of executing the movement sequence of the leno threads by means of heald frames and using dobbies as well as corresponding heald frame drives has also been retained in more recent weaving machines. If a weaving machine of this kind is used exclusively for the manufacture of leno fabrics, then this weaving machine has an unused potential, which gives rise to unnecessary costs.

SUMMARY OF THE INVENTION

It is an object of the invention to provide an apparatus for weaving machines which are only used for the manufacture of leno fabrics, by means of which the sequence of movements which is required for the ground threads and leno threads can be carried out, with this apparatus being intended to enable the construction of more economical weaving machines as a result of an expedient design.

The apparatus for the manufacture of leno fabrics in a weaving machine comprises a needle bar for ground threads, at least one insertion element for leno threads and means for the insertion of weft threads. A pivotal arrangement is connected directly to a main drive of the weaving machine. The insertion element and the needle bar can be moved by means of this pivotal arrangement, so that the movement sequence which is required for the ground threads and leno threads results.

In the following the invention will be explained with reference to the drawings.

DESCRIPTION OF THE PREFERRED EMBODIMENTS

Figure 1:
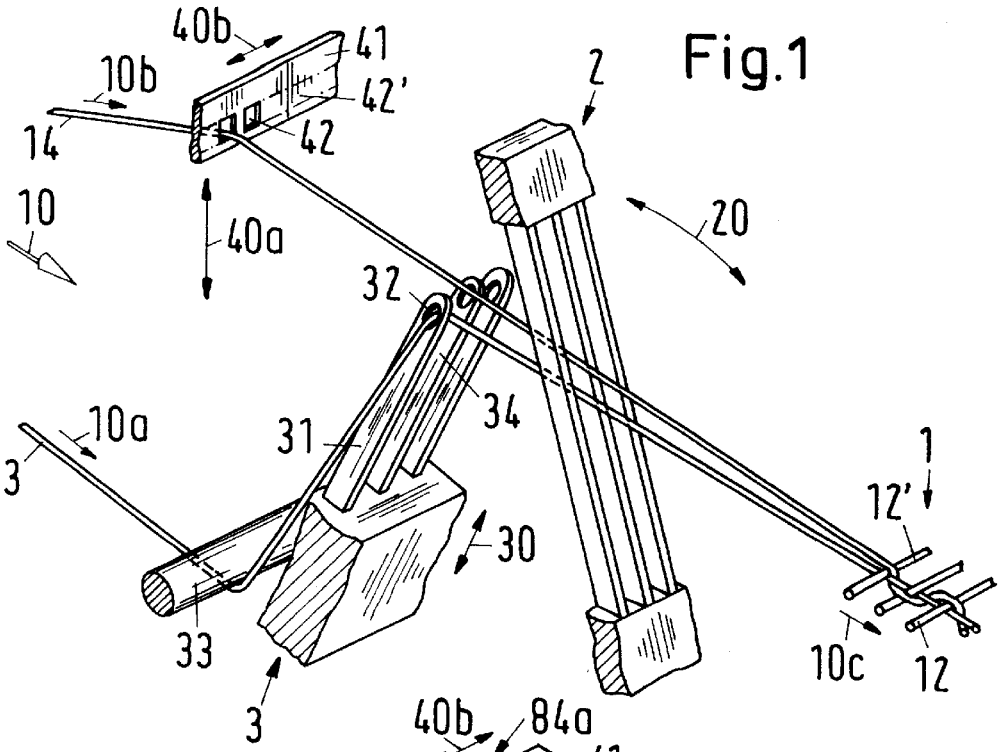
FIG. 1 is a schematic for the purpose of the spatial illustration of a method for the manufacture of leno fabrics.
Figure 2:
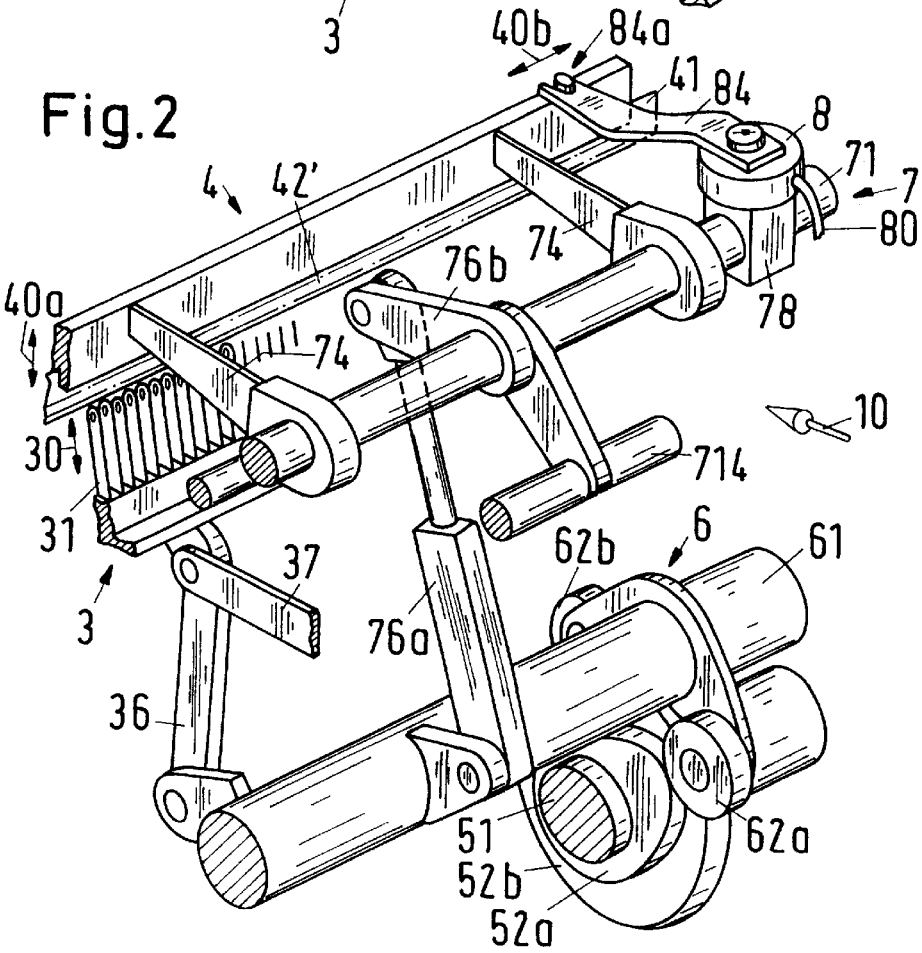
FIG. 2 is a part of an apparatus in accordance with the invention in perspective view.
Figure 3:
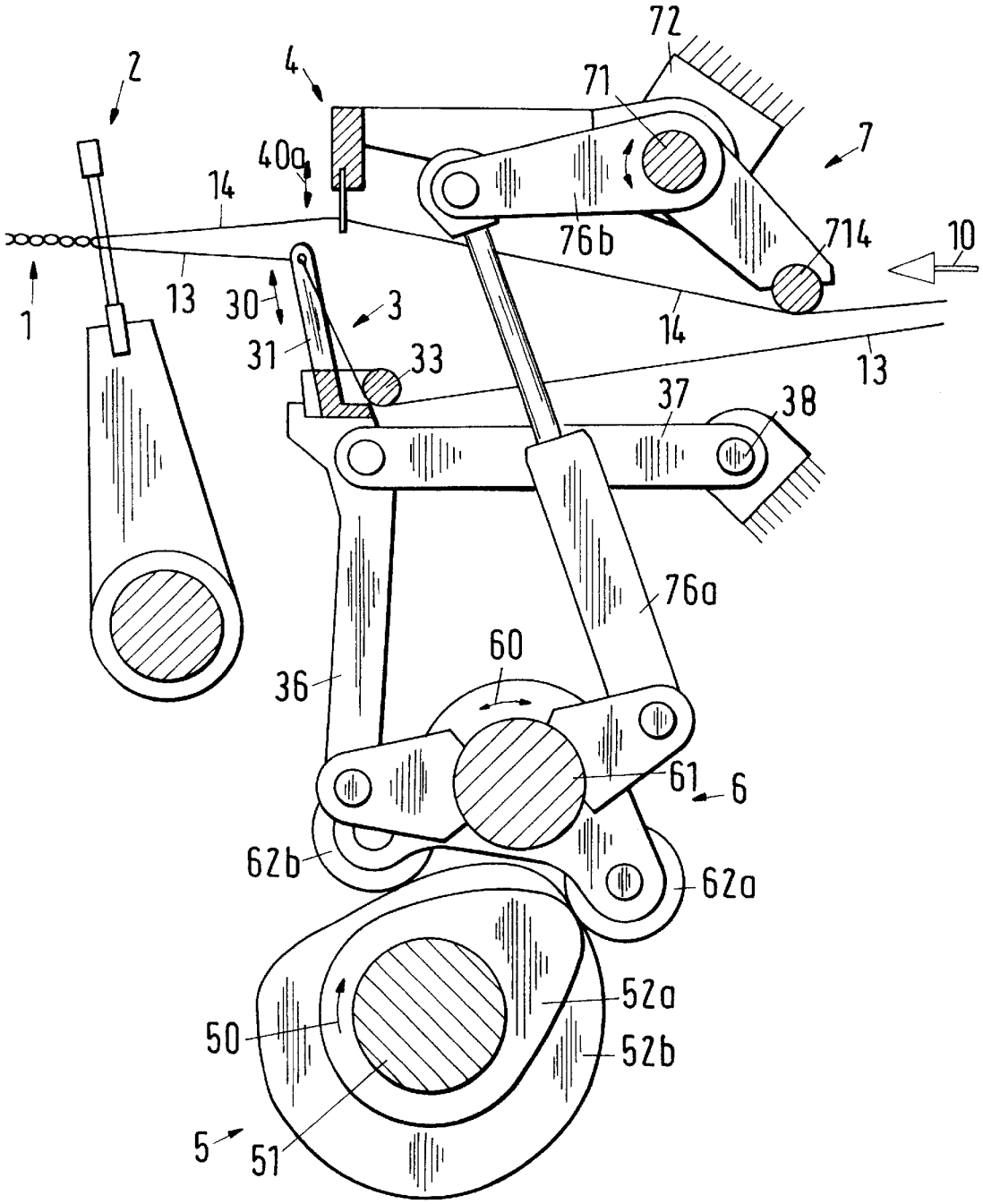
FIG. 3 is a side view of the same apparatus.

In the manufacture of a leno cloth 1 from weft threads 12 and warp threads, namely ground threads 13 and leno threads 14, the ground threads 13 are guided by a needle bar 3 and the leno threads 14 by an insertion element 4—see FIGS. 1 to 3. The needle bar 3 carries needles 31 with eyes 32. The insertion element 4 contains an insertion rail 41, which is a perforated rail with holes 42. A series of regularly arranged holes 42 is indicated in chain-dotted lines as a strip 42'. In FIG. 1 the transport direction 10 of the warp threads 13 and 14 (arrows 10*a* and 10*b* respectively) and of the cloth 1 (arrow 10*c*) extends in the forward direction. In the corresponding arrangement of FIG. 2 the transport direction 10 is reversed, from right to left in FIG. 3.

A reed 2 between the needle bar 3 and the cloth 1 is actuated for beating up a newly inserted weft thread 12': double arrow 20. The needle bar 3 with needles 31 and the insertion element 4 with the insertion rail 41 are moved up and down in opposite senses: double arrows 30 and 40*a* respectively. A displacement movement 40*b* is superimposed as a second component of movement on the first component of movement 40*a* of the insertion rail 41. The stroke of the displacement movement 40*b* is chosen in such a manner that the leno thread 14 is in each case moved back and forth between adjacent gaps 34 of the needle bar 3. It is at least equal to the distance between two adjacent needles 31. If it is chosen to be greater than this distance, then abutment lamella which protrude beyond the ground needles and thus enforce the dipping in into the correct gap 34 must be arranged between the ground needles (see the above-named DE 466 340 C). In order that the first component of movement 40*a* of the insertion element 4 can take place outside the region of the ground threads 13, the latter are deflected downwardly via a deflection bar 33. The manufacture of the leno binding will be explained further below with reference to FIGS. 4 to 6.

The apparatus in accordance with the invention, comprising a specially designed pivotal arrangement which consists of components 5, 6 and 7, is illustrated in FIGS. 2 and 3. This pivotal arrangement, by means of which the insertion element 4 and the needle bar 3 are moved, is connected directly to the main drive of the weaving machine via a shaft 51 of the component 5. The drive power is transmitted from the shaft 51 (rotary movement 50) via cams 52*a*, 52*b* to a cam follower or roller follower drive 6.

The pivotal arrangement comprises a first axle 61 and a second, oppositely movable axle 71, which are oriented parallel to the insertion path of the weft thread 12 (FIG. 1) and which are mounted in a fixed position in space in non-illustrated side walls of the weaving machine. The first axle 61 is set into a pendulum or oscillating rotation 60 through the cam follower drive 6 via the cams 52*a*, 52*b* and corresponding rollers 62*a*, 62*b*. The needle bar 3 is arranged at a first knee crank or toggle lever 36, 37 between the first axle 61 and a fixed pivot 38 (FIG. 3). The second axle 71 is set into a pendulum or oscillating rotation 70 reversed with respect to the first axle 61 via a second knee crank or toggle lever 76*a*, 76*b*. A connection 74 between the second axle 71 and the insertion element 4 transmits the pivotal movement to the latter and thus produces the vertical component of movement 40*a* of the insertion rail 41.

The cam follower drive 6 is advantageously arranged in a middle region of the first axle 61. A non-illustrated bearing of the main drive shaft 51 can be arranged to be directly adjacent to the cam follower drive 6. A drive through two or more cam follower drives 6 can be provided. Then these cam follower drives 6 are arranged so as to be distributed over the inner region of the first axle 61.

A leno thread deflection bar 714 is provided at the second axle 71 and serves for the temporary tensioning of the leno threads 14: see FIG. 3.

For the execution of the lateral displacement movement 40*b*, the insertion element 4 is movably arranged at the pivotal arrangement. The displacement movement 40*b* is driven by means of at least one motor 8 which acts on the insertion element 4.

In the exemplary embodiment of FIG. 2 the insertion element 4 is secured to the second axle 71 via elements 74 which are designed as leaf springs. The motor 8 is connected via a cable 80 to a non-illustrated control system and an energy source. It is mounted on a block 78 which is firmly connected to the second axle 71. For the execution of the displacement movement 40*b* a control lever 84 which can be driven by the motor 8 is connected to the insertion element 4. A connection 84*a* at the insertion element 4 consists of a fork at the control lever 84 and a pin, which is secured at the insertion element 4 and which protrudes into the intermediate space of the fork.

Figure 4:
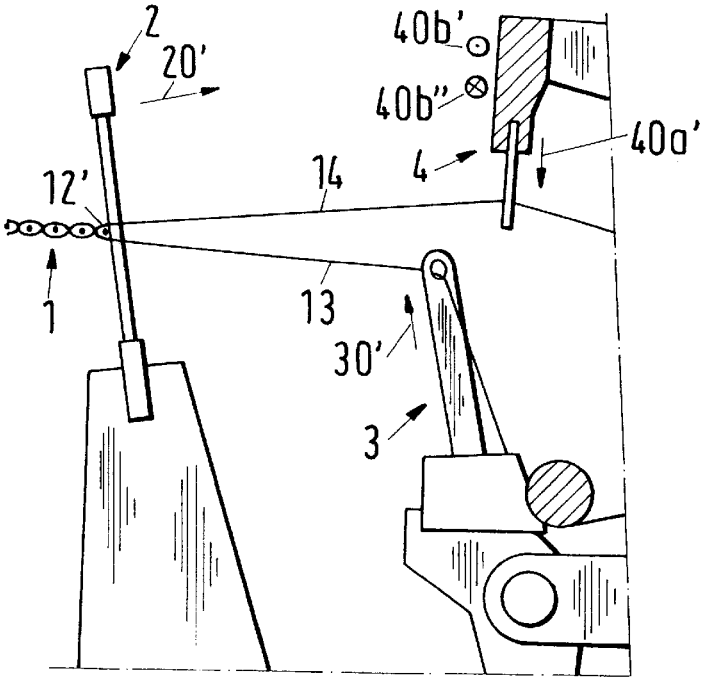
FIGS. 4–6 are three working phases of the apparatus of this invention, illustrated with reference to the positions of a reed, a needle bar and an insertion element during apparatus operation.
Figure 5:
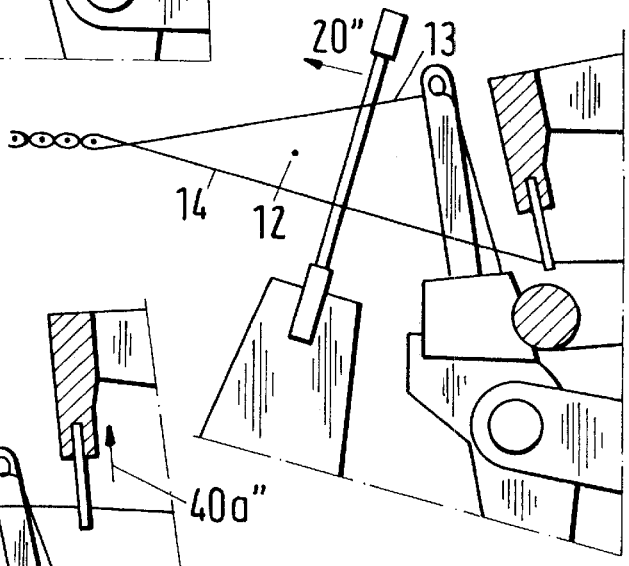
Figure 6:
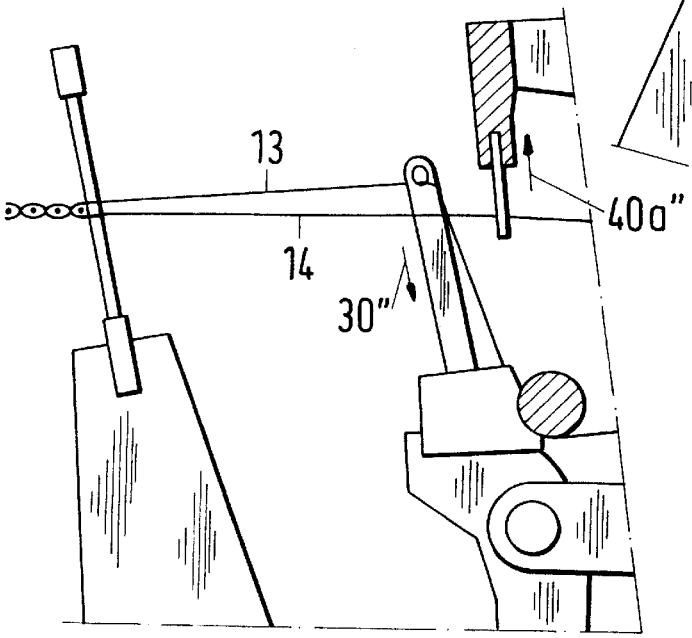

Three working phases are shown in FIGS. 4 to 6 by an illustration of the positions which the reed 2, the needle bar 3 and the insertion element 4 assume. In the phase of FIG. 4 the newly beat-up weft thread 12' is bound in, in that the insertion element 4 executes a displacement movement 40*b*' in the horizontal direction and a vertical movement 40*a*', while the needle bar 3 executes a vertical movement in the opposite direction. The reed 2 moves away from the selvedge: arrow 20'. The shed between the ground threads 13 and the leno threads 14 opens; a new weft thread 12 can be inserted: FIG. 5. The weft thread 12 is beat up by the reed 2: arrow 20". The insertion element 4 moves—see FIG. 6—upwards again: arrow 40*a*"; the needle bar 3 downwards: arrow 30'. The situation of FIG. 4 sets in. In the following binding in of the weft thread 12, now again with the reference symbol 12', the displacement movement 40*b*" is directed oppositely to the previous displacement movement 40*b*'.

Figure 7:
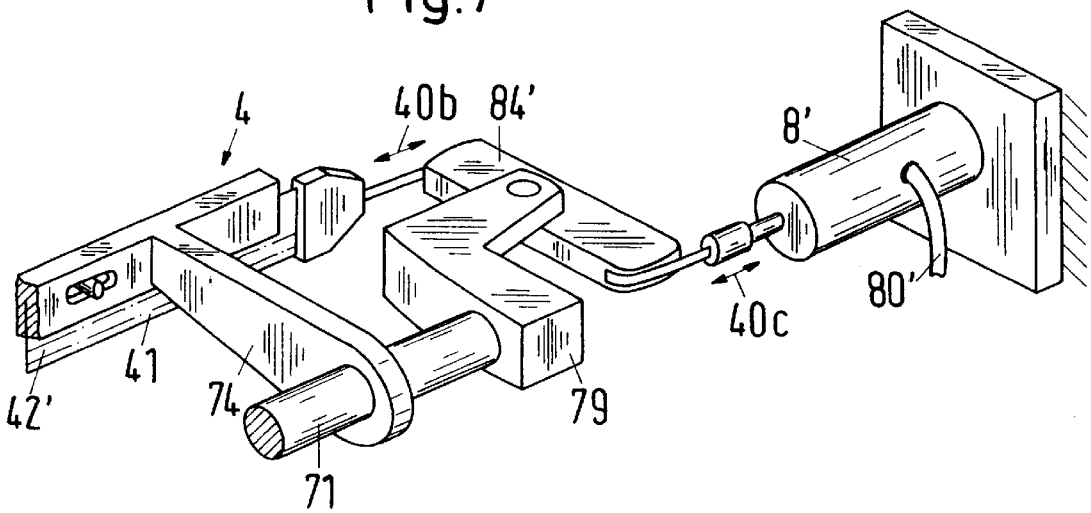
FIG. 7 is a first variant pertaining to a means.

FIG. 7 shows a second possibility of how the displacement movement can be executed. The insertion element 4 is secured to the second axle 71 via rigid elements 74. The insertion rail 41 can be displaced in a groove in the insertion element 4. A motor 8' (connection cable 80' is arranged in a fixed position. The motor 8' is a linear motor, by means of which a back and forth movement 40*c* can be carried out in cooperation with a spring or a second linear motor (not shown; see the following example of FIG. 8). For carrying out the displacement movement 40*b* a rocker member 84' which is driven by the motor 8' is connected to the insertion rail 41. The rocker member 84' is pivotally mounted onto a part 79 which is firmly connected to the second axle 71. It is thus pivoted up and down together with the insertion element 4.

Figure 8:
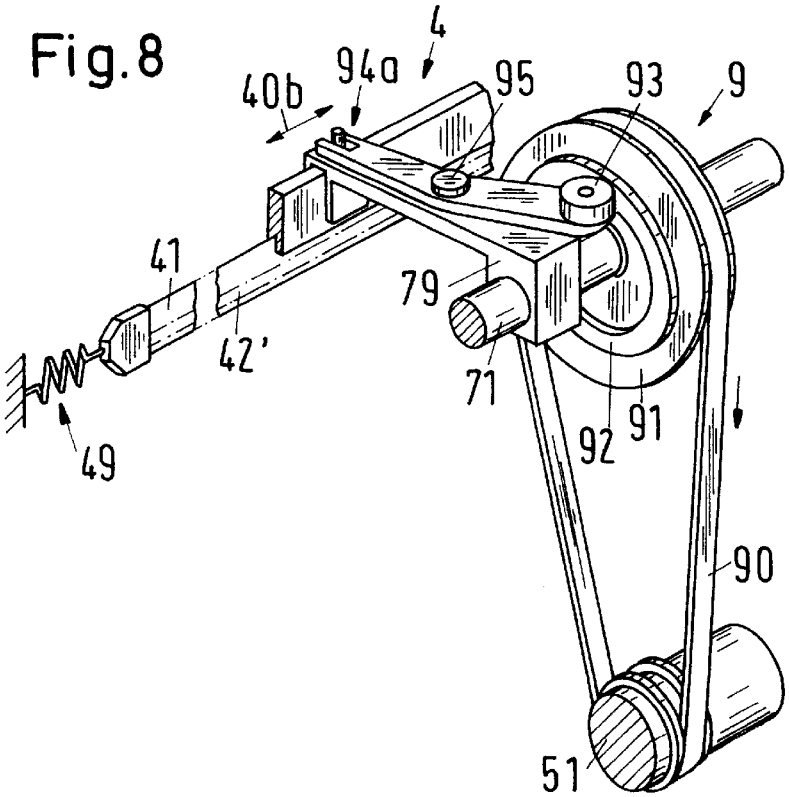
FIG. 8 is a second variant pertaining to a means by which a lateral displacement movement of the insertion element can be executed.

A purely mechanical means 9 for carrying out the displacement movement 40*b* is shown in FIG. 8. The main drive shaft 51 drives via a transmission belt 90 an axial cam 91, which runs freely rotating on the second axle 71. Through the transmission the speed of rotation is halved. The displacement movement 40*b* is produced at the insertion element 4 through a cam profile 92 of the axial cam 91 and in cooperation with a tension spring 49, a roller 93, and a control lever 94 on which the roller 93 is rotatably mounted. The axis of rotation 95 of the control lever 94 is advantageously formed as an eccentric cam, so that the stroke of the displacement movement 40*b* can be varied, in particular for a fine tuning. A connection 94*a* between the control lever 94 and the insertion element 4 is formed the same as the connection 84*a* of the example shown in FIG. 2. As in this example, the insertion element 4 is also secured by means of leaf springs 74 at the second axle 71 (not illustrated in FIG. 8).

What is claimed is:

1. Apparatus for the manufacture of leno fabrics (1) in a weaving machine comprising:

a needle bar (3) for ground threads (13);

at least one insertion element (4) for leno threads (14);

a pivotal arrangement (5, 6, 7) which is connected directly to the main drive (51) of the weaving machine and by means of which the insertion element (4) and the needle bar (3) can be moved, the pivotal arrangement including:

a first axle (61) and a second axle (71) oriented parallel to the insertion path of the weft thread (12) for rotational movement in opposite directions;

a first knee crank (36, 37) between the first axle (61) and a fixed pivot (38) to provide for up-and-down movement of the needle bar (3) for the ground threads (13);

a second knee crank (76*a,* 76*b*) connected to the first axle (61) to provide for down and up pivotal movement of the insertion element (4) for leno threads (14); and, a cam follower drive (6) for enabling the first axle (61) to be driven by the main drive (51).

2. The apparatus for the manufacture of leno fabrics (1) in a weaving machine according to claim 1, and wherein:

the cam follower drive (6) is arranged in a middle region of the first axle (61).

3. The apparatus for the manufacture of leno fabrics (1) in a weaving machine according to claim 1 and wherein:

a plurality of cam follower drives are spaced apart in the inner region of the first axle (61).

4. The apparatus for the manufacture of leno fabrics (1) in a weaving machine according to claim 1 and wherein:

a leno thread deflection bar (714) is attached to the second axle (71) for the temporary tensioning of the leno threads (14).

5. The apparatus for the manufacture of leno fabrics (1) in a weaving machine according to claim 1 and wherein:

the insertion element (4) is movable with the pivotal arrangement (5, 6, 7); and, a motor (8) acts on the insertion element for displaced movement (40*b*) in the direction of the weft thread (12).

6. The apparatus for the manufacture of leno fabrics (1) in a weaving machine according to claim 5 and wherein:

leaf springs (74) secure the insertion element (4) to the second axle (71);

the motor (8) is mounted to the second axle; and, a control lever (84) is driven by the motor (8) for the execution of the displacement movement (40*b*) on the insertion element (4).

7. The apparatus for the manufacture of leno fabrics (1) in a weaving machine according to claim 5 and wherein:

the insertion element (4) is secured via a rigid element (74) to the second axle (71); and an insertion rail (41) is displaceably held in the insertion element (4);

the motor (8) is stationary; and, a rocker member (84') is driven by the motor and connected to the insertion rail for carrying out the displacement movement (40*b*).

8. The apparatus for the manufacture of leno fabrics (1) in a weaving machine according to claim 1 and wherein:

the insertion element (4) is movably arranged at the pivotal arrangement (5, 6, 7) for the execution of a displacement movement (40*b*) in the direction of the weft thread (12) in insertion; and, a mechanism (9) connected to the main drive shaft (51) displaces the insertion element (4).

* * * * *